United States Patent [19]

Smith et al.

[11] Patent Number: 4,932,554

[45] Date of Patent: Jun. 12, 1990

[54] LID RETAINING COLLAR

[75] Inventors: Peter J. Smith, Wantage; Andrew P. Pavely, Blunsdown, both of England

[73] Assignee: CMB Packaging (UK) Limited, United Kingdom

[21] Appl. No.: 323,725

[22] Filed: Mar. 15, 1989

[30] Foreign Application Priority Data

Mar. 25, 1988 [GB] United Kingdom ..... 8807117

[51] Int. Cl.[5] ..... B65D 45/32

[52] U.S. Cl. ..... 220/319; 220/285

[58] Field of Search ..... 220/306, 319, 320, 321, 220/354, DIG. 25, 285

[56] References Cited

U.S. PATENT DOCUMENTS

| | | | |
|---|---|---|---|
| 1,632,031 | 6/1927 | Mauser | 220/320 |
| 1,847,245 | 3/1932 | Hothersall | 220/319 |
| 2,071,971 | 2/1937 | Draper et al. | 220/320 |
| 2,305,579 | 12/1942 | Varker | 220/285 |
| 2,591,482 | 4/1952 | Weltlich | 220/319 X |
| 3,913,785 | 10/1975 | Pattershall | 220/354 |
| 4,279,358 | 7/1981 | Jacobs | 220/321 |
| 4,625,890 | 12/1986 | Galer | 220/319 |
| 4,718,571 | 1/1988 | Bordner | 220/380 |
| 4,728,003 | 3/1988 | Davey | 220/319 |

FOREIGN PATENT DOCUMENTS

| | | | |
|---|---|---|---|
| 0552834 | 2/1958 | Canada | 220/354 |
| 0624356 | 7/1981 | Switzerland | 220/319 |

*Primary Examiner*—Stephen Marcus
*Assistant Examiner*—Nova Stucker
*Attorney, Agent, or Firm*—Diller, Ramik & Wight

[57] ABSTRACT

A plastic collar for retaining a plug lid 45 in a ring 44 double seamed to can body 1, has a peripheral skirt 38 portion having on its interior surface a snap fit bead 41 for entering under the double seam 3; a planar annulus 37 extending radially inwards from the top of the skirt over the seam 3 and at least part of the ring 44 and lid 45; and an annular rib 43 extending down from the planar annulus to hold the lid in the ring. The collar may be provided with a jacking screw 39 to assist removal from interlock with the double seam 3 and progressive removal is facilitated by a radial slit or line of weakness at which the collar first parts from the can.

14 Claims, 2 Drawing Sheets

LID RETAINING COLLAR

TECHNICAL FIELD

This invention relates to a collar for retaining a plug lid in a ring double seamed to a can body.

Metal clips are known which have a generally "u" shaped form one leg of which has a hook for entering under the double seam as the rest of the clip spans the double seam and ring so that the other leg of the clip engages the plug wall of the lid. Fitting of such clips is laborious.

BACKGROUND ART

In an attempt to facilitate fitting of such metal clips, our British Patent No. 1555767 proposed that the clips be connected leg to leg by bridge pieces, so that several clips can be pushed up at once and progressively hammered onto the lidded can: However, these collective clips never became popular.

An overcap of plastics material is also known which comprises a planar cover disc which spans the whole lid/ring and is held onto the can by a crimped-on skirt depending from the cover disc and hooked under the double seam. However, a considerable quantity of plastics material is required to span the whole lid and ring of larger paint tins such as the 2.5 and 5 liter sizes and any yielding of the planar disc may permit the lid to yield during abuse of the container.

British Patent Application Published No. 2096107 (Nacanco) describes a clip for holding a plug lid in the ring of a paint tin. The clip has as essential features an outer member arranged to resiliently engage with the underside of the double seam, a second intermediate member arranged to resiliently engage an inner surface of the ring and/or an outer surface of the periphery of the lid, and a third, inner member arranged to engage the plug wall of the lid. It is mentioned that the clip may be made in the form of a ring of resilient plastics material. Such a notional ring will be liable to be difficult to remove from the tin once it is snap fitted into the locking position on a tin.

European Patent Application Published No. 0246 783 (Francis Packaging) describes a removable device for retaining a plug lid in a ring attached to a container body by a double seam. In one embodiment the device is an annular moulding of plastics material having a "U" shaped cross section the innermost limb of which fits inside the plug lid and the outermost limb being in the form of a plurality of inwardly barbed fingers equispaced around the device. The barbed fingers are shaped to snap fit under the double seam of a container body to hold the device firmly on the lid. If a flexible plastics material is used to achieve moulded fingers that are easy to fit, the device may not be secure. If a stiffer plastics material is used such as nylon the device may be very difficult to remove, and if less stiff material is used, the fingers may provide inadequate grip on the seam and inadequate cushioning against abuse.

SUMMARY

We have discovered that it is possible to make such moulded Plastics rings removable by providing locking rings (or collars) interrupted by a slit or line of weakness without unduly imparing the retaining quality of the retention of the lid in the ring.

Accordingly this invention provides a collar of plastics material for retaining a plug lid in a ring double seamed to can body, said collar comprising a depending peripheral skirt portion having on its interior surface a snap fit bead for entering under the double seam; a planar annulus extending radially inwards from the top of the skirt over the seam and at least part of the ring and lid; and an annular rib extending down from the planar annulus to hold the lid in the ring characterised in that the skirt, the planar annulus, and the annular rib are interrupted by a split or line of weakness across the collar. A benefit arising from provision of a split or line of weakness is that the collar is easier to prise off a container during opening.

Further benefits arising from our collar are that the outer skirt and annular rib of our collar limits axial distortion of the can by virtue of their rigidity and furthermore radial distortion of the can is limited by combination of the inner rib and radial extent of the planar annulus.

In a first embodiment the annular rib is adapted to fit within the plug wall of the lid and hold the lid in sealing engagement with the ring: It is preferable that the planar annulus extends radially inwards beyond the annular rib to increase the radial strength of the collar.

In a second embodiment the annular rib is adapted to be a close fit in a lid having a channel portion.

In a third embodiment the annular rib is adapted to fit within the chuck wall of a ring and has a wedge surface to thrust against the periphery of the lid to hold the lid firmly into the aperture in the ring.

In a fourth embodiment the collar has means to facilitate opening, such as a screw jack to force the collar past the double seam.

DESCRIPTION OF THE PREFERRED EMBODIMENTS

Figure 1:
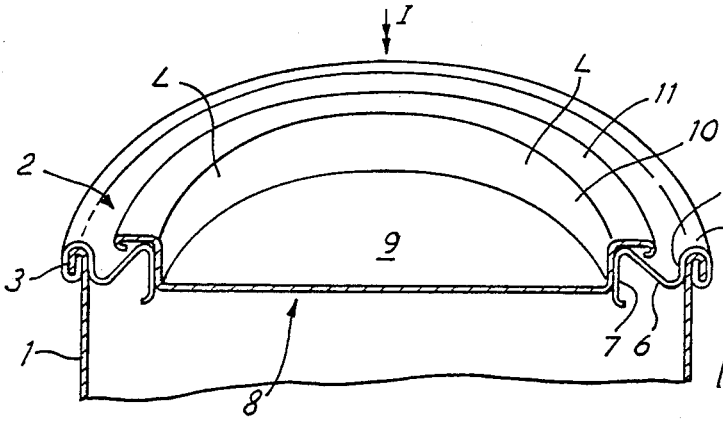
FIG. 1 is a perspective view of an upper part of a lidded can sectioned on a diameter.

FIG. 1 shows a cylindrical can body 1 joined to a ring 2 by a double seal 3. The ring comprises a seam portion 4, a countersink wall 5 depending from the inside of the seam, an upwardly flaring portion 6 and an inwardly directed cylindrical wall 7 which defines an aperture. A plug lid 8 has a central panel 9, a peripheral plug wall 10 and an outwardly directed flange 11 the periphery of which is curled as shown.

When a filled can, such as depicted in FIG. 1, is dropped onto a hard surface so that an impact force denoted I strikes the double seam, the ring is deflected from round to some ovality so that the fit of the round lid in the aperture relaxes at the spaced zones L,L and leakage can occur. Severe impacts can also cause the lid to bend so its dimension across the bend is reduced to further spoil the lid fit in the aperture. We have observed that if the lid and ring assembly are supported against (a) radial forces and (b) axial distortion, it is possible to make the plug lid/ring seal much better and be able to resist abuse. These objectives are achieved by providing a collar which snap fits under the double seam and extends across the ring to hold the lid in the ring.

Figure 2:
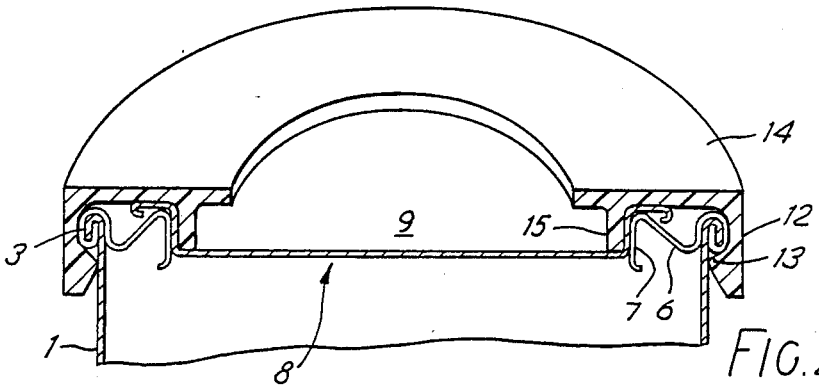
FIG. 2 is a like view of the can of FIG. 1 and a first embodiment of the collar which holds the lid upon the can body.

In FIG. 2 a first embodiment of the collar comprises a depending skirt portion 12 having an annular bead 13 snap fitted under the double seam 3; a planar annulus 14 extending radially inwards from this skirt portion 12 to span the ring and lid and an annular rib 15 which depends from the planar annulus to enter the hollow of the lid 8, as defined by the plug wall 10 of the lid, to hold the lid down in the aperture. The collar is moulded from a polypropylene such as that denoted "TKPP" from TK Plastic Limited, but other materials such as polyamides, e.g. nylon 6 may be suitable. It is believed that the planar annulus 14 gives radial resistance to abuse so that it is desirable to extend its width beyond the annular rib towards the centre of the collar but the aperture in the centre of the annulus does save plastic material without significant loss of functional strength.

Figure 3:
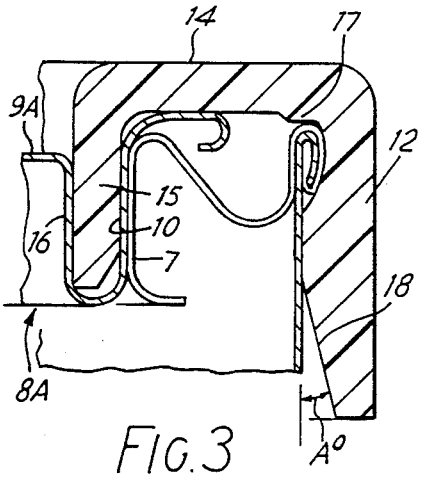
FIG. 3 is an enlarged sectional view of a second embodiment of the collar holding a different form of lid on a can body.

In FIG. 3 another form of lid 8A is shown to have a raised centre panel 9A supported on a wall 16 which defines with the plug wall 10 a channel into which the annular rib 15 extends. The planar annulus 14 extends radially outward from the annular rib to a thickened portion 17 at which it joins the skirt 12. In FIG. 3 it can be seen that the interior surface of the skirt 12 has a flared entry surface 18 which facilitates snap fitting of the collar onto the lidded can. The angle A° of collar flare to the side wall of can is about 76°. Whilst the skirt 12 is depicted in FIG. 3 is a tight fit on the side wall 1, a tight fit is not essential as will be discussed later by reference to FIG. 8.

Figure 4:
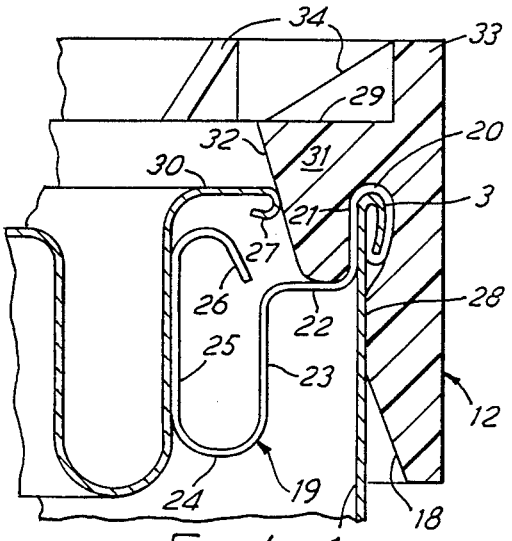
FIG. 4 is an enlarged sectional view of a third embodiment of the collar in which a wedge surface of the collar engages the periphery of the lid.

In FIG. 4 the can body 1 is attached by means of a double seam 3 to what is called, in the trade, a "cushion ring" 19. The cushion ring comprises a peripheral seam portion 20, a chuck wall 21 depending from the interior of the seam portion, a flat annulus 22 extending radially inwards from the chuck wall, a wall portion 23 depending from the interior of the flat annulus and extending axially in a direction away from the seam portion to a bend portion 24 which supports a substantially cylindrical surface 25 defining the aperture in the ring 19. The free edge of the cylindrical surface terminates in an outwardly directed curl 26.

The substantially cylindrical surface 25 of the cushion ring gives a resilient sealing support to the plug wall 10 of a lid having a flange terminating in a peripheral curl 27.

In FIG. 4 a third embodiment of the collar comprises a skirt portion 12 having a flared entry surface 18 and a thickened portion 28 which extends under the double seam 3 to achieve a snap-on fit. In contrast to the embodiments of FIGS. 2 and 3 the collar of FIG. 4 has a narrow planar annulus 29 which only spans the double seam 3 and a marginal portion of the lid flange 30. An annular rib 31 depends from the planar annulus to enter the space between the periphery of the lid curl 27 and chuck wall 21 so that a wedge surface 32 presses on the curl 27 of the lid and at most reaches the flat annulus 22 of the cushion ring. The benefits of this form of collar are that:

(a) the wedge surface 32 is able to drive the lid to a seal position; and (b) the collar is narrow so any hydraulic thrust on the lid, exerted when a filled can drops onto a hard surface, is passed without much leverage onto the collar skirt 12.

If desired the collar of FIG. 4 may also include (as shown) an annular extension 33 to the skirt into which buttresses 34 direct any forces received from the planar annulus. If desired, the buttresses can be notched or stop short of the top to permit stacking of a can within the annular extension.

When a user comes to open the cans of FIGS. 2, 3 and 4, he is faced with a problem because all the surfaces usually used to lever open a lever lid are covered by collar portions and the collars are firmly snap fitted. FIGS. 5 to 8 depict a collar adapted for easy removal from a lidded can.

Figure 5:
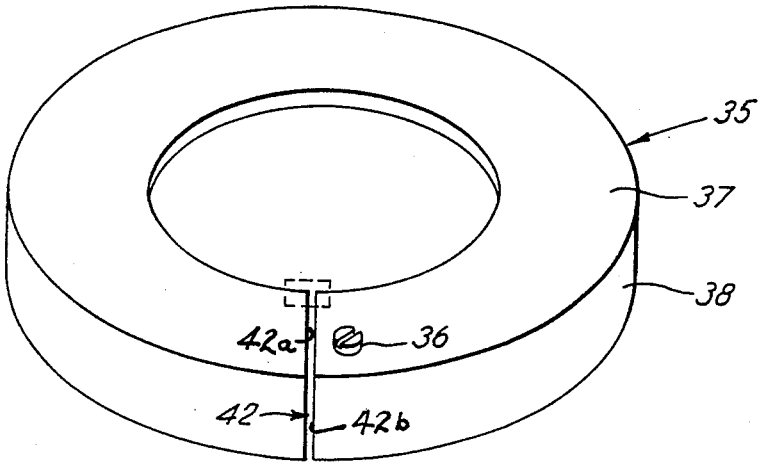
FIG. 5 is a perspective view of a collar having a radial split and a jacking screw.
Figure 6:
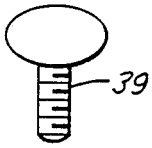
FIGS. 6 and 7 respectively depict a thumbscrew and a grub screw.

FIG. 5 shows a collar 35 provided with a jacking screw 36 arranged to penetrate a threaded bore in the planar annulus 37 to engage with double seam, ring or lid so that rotation of the screw causes the skirt 38 to be pulled past the double seam to release the collar and provide access to the lid which can then be prised from a ring in the usual manner.

Figure 7:
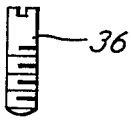

A jacking screw can, of course, be incorporated in the embodiments of FIGS. 2, 3 or 4 and may either be in the form of the grub screw 36 shown in FIGS. 5 and 7 and sold ready fitted in the collar; or alternatively, for transit, a thumbscrew 39 may have to be fixed to the can lid by integral moulding to the collar or alternatively fixed by adhesive tape as a separately moulded item to the lid because, when in situ, it would prevent stacking of cans.

Figure 8:
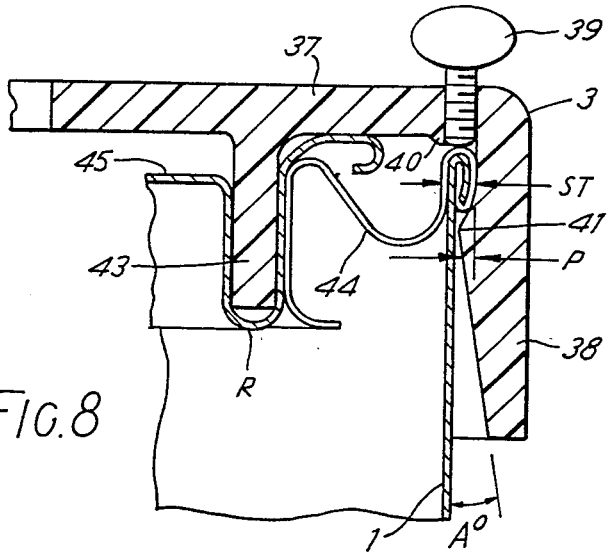
FIG. 8 is a fragmentary radial section through the collar of FIG. 5 to show how the jacking screw acts against the can seam.

In FIG. 8 it will be seen that the thumbscrew 39 penetrates a thickened portion 40 of the planar annulus 37 to engage upon the double seam 3 portion of the ring. This is probably the preferred position because the lifting force, arising as the screw is rotated, is directed in line with the snap fit bead 41 of the skirt so that no loss of motion arises by flexure of the planar annulus 37 as could happen if the screw were positioned further inwards on a radius of the planar surface.

In FIG. 8 the thickness ST of double seam 3, is typically about 1.3 mm (0.055 inch) and the penetration "P" of the snap fit skirt bead 41 is about 0.9 mm (0.035 inch) under the double seam 3 so that there is a clearance between the can wall 1 and the interior of the collar skirt 38. Depending on the flexibility of material chosen for the collar this degree of interference can be varied but using a polypropylene we find this degree of interference gives useful lid retention as shown in Table 1 which follows: A lead in flare angle A° of about 76° of skirt to can side wall permits snap fitting of the collar on the double seam 3.

Returning to FIG. 5 it will be seen that the collar includes a radial slit 42 defined by circumferentially opposing spaced faces **42*a*, 42*b*. The radial slit 42 interrupts the continuity of the skirt 38 planar annulus 37 and rib 43. When fitted to a can 1, ring 44 and lid 45 assembly as shown in FIG. 8** the split collar performed nearly as well as comparable intact (not split) collars as can be seen from the following table of drop test results done on 2.5 liter paint tins held shut by complete or split collars as tabulated.

If desired the split line 42 may extend on a line inclined to a true radius so that skirt and rib overlap at the can slit, in the manner of a "scarfed joint".

It is to be understood that all of the embodiments described herein are to be provided with a split 42 as shown in FIG. 5 or alternatively the split may be replaced by a line of weakness.

The results tabulated in Table 1 were obtained by filling and lidding 2.5 liter paint cans of the kind having a cushion ring and cushion lid as depicted in FIG. 8. Onto some cans a split collar (cut through) was fitted and onto other cans complete or intact collars were fitted: The cross section of both types of collar is as shown in FIG. 8.

The depth of annular rib 43 was 11.0 mm and the depth of channel in the cushion lid was 11.64 mm to the bottom of the channel radius so that the annular rib reaches to touch the root radius "R" which is about 2.03 mm. Table 1 follows:

TABLE I

| 2.5 LITER PAINT TINS 1.2M DROP TESTS | | | |
|---|---|---|---|
| PLASTIC CLIP | | SAMPLES TESTED | OBSERVATIONS |
| MARK I .040" penetration below D. seam | INTACT | 1 can (water 98% GLV) | N/L from impact region. Slight lid bulge, clip in position |
| (std. int. ø 130 mm) | CUT-THROUGH | 1 can (water 98% GLV) | N/L (as above) |
| MARK II 0.035" penetration below D. seam | INTACT | 1 can (water 98% GLV) | N/L from impact region. Very slight lid bulge clip in position. |
| (std. int. ø 130 mm) | CUT-THROUGH | 7 cans (water 98% GLV) 6 cans (cellulose paint 98% GLV) | N/L from impact region v. slight lid bulge. Clip lifted slightly at one side of cut-through, towards impact region on 7 of the cans |
| MARK III 0.030" penetration below D. seam | INTACT | 1 can (water 98% GLV) | N/L from impact region. Very slight bulge. Clip in position |
| (std. int. ø 130 mm) | CUT-THROUGH | 1 can (water 98% GLV) | |
| MARK IIB .035" penetration below D. seam | INTACT | 1 can (water 98% GLV) | Slight closure leakage (unpierced B/E) on one edge of impact region Clip in position |
| | CUT-THROUGH | 1 can (water 98% GLV) | Slight closure leakage after piercing B/End. Slight lid bulge. bulge. Clip lifted at one side of cut-through |
| (Int. ø 132 mm) | | 1 can (cellulose paint 98% GLV) | N/L from impact region. Clip lifted as above. |
| MARK IIC .035" penetration below D. seam | INTACT | 1 can (water 98% GLV) | Slight closure leakage (unpierced B/E) on one edge of impact region. Clip in position |
| | CUT-THROUGH | 1 can (water 98% GLV) | Slight closure leakage after piercing B/End. Slight lid bulge. bulge. Clip lifted at one side of cut-through |
| Int. ø 134 mm) | | 6 cans (cellulose paint 98% GLV) | N/L from impact region. Clip |

TABLE I-continued

| 2.5 LITER PAINT TINS 1.2M DROP TESTS | | |
|---|---|---|
| PLASTIC CLIP | SAMPLES TESTED | OBSERVATIONS |
| | | lifted as above |

Key:
GLV = gross lidded volume
N/L = no leakage
Ø = diameter

Whilst each embodiment depicted introduces a different feature it will be understood that features of one Figure may be exchanged or incorporated with features of another Figure. For instance, the jacking screw of FIGS. 7 or 8 can be incorporated in the collars of FIGS. 2, 3 or 4. The buttressed annular extension 33 can be incorporated in the collars of FIGS. 2, 3 and 4 if a stacking feature is required.

As an alternative to use of a jacking screw the collars may be moulded from a tearable plastics material such as polyethylene so that a removable portion of the skirt, defined by lines of weakness or reduced thickness, can be torn to release the collar from the double seam. It is possible to include such a line of weakness instead of the slit 42 in the collar of FIG. 5 so that the jacking action of the screw breaks the line of weakness to progressively lift the collar skirt free of the double seam.

In order to facilitate complete filling of the mould used to make the split collar of FIG. 5 it is desirable to bridge the slit, preferably at a region near the central aperture so that the bridge does not significantly restraint the jacking action. A suitable bridge region is identified by the box in dashed lines in FIG. 5.

We claim:

1. A single collar of plastics material for retaining a plug lid in a ring double seamed to a can body, said single collar comprising a depending peripheral skirt portion having on its interior surface a snap fit bead for entering under the double seam; a planar annulus extending radially inwards form the top of the skirt over the seam and at least part of the ring and lid; and an annular rib extending down from the planar annulus to hold the lid in the ring, characterised in that the skirt, planar annulus and the annular rib are interrupted by a radial split defined by circumferentially opposing faces.

2. A collar according to claim 1, wherein the planar annulus extends radially inwards beyond the annular rib to define a central aperture in the collar.

3. A collar according to claim 1, wherein the annular rib has an external diameter to fit within the plug wall of the plug lid.

4. A collar according to claim 3, wherein the annular rib has an axial length sufficient to reach and when fitted press upon the bottom radius of the plug wall adjoining the central panel of a lever lid.

5. A collar according to claim 1, wherein the annular rib has an external dimension to fit within the chuck wall of a ring and an internal sloping surface to abutt the peripheral flange of a lid.

6. A collar according to claim 1, having a jacking screw which passes through a threaded bore in the planar annulus.

7. A collar according to claim 6, wherein the jacking screw and threaded bore are located to align with the double seam when fitted on a can.

8. A collar according to claim 1, wherein the skirt has an annular extension upstanding beyond the planar annulus.

9. A collar according to claim 2, wherein the annular rib has an external diameter to fit within the plug wall of the plug lid.

10. A collar according to claim 1 wherein said circumferentially opposing faces are in spaced relationship to each other.

11. A collar according to claim 2 wherein said circumferentially opposing faces are in spaced relationship to each other.

12. A collar according to claim 1 wherein said radial split is the only radial split of said single collar.

13. A collar according to claim 2 wherein said radial slit is the only radial split of said single collar.

14. A collar according to claim 11 wherein said radial split is the only radial split of said single collar.

* * * * *